US009496663B2

(12) United States Patent
Xiao et al.

(10) Patent No.: US 9,496,663 B2
(45) Date of Patent: Nov. 15, 2016

(54) TRANSMISSION MODULE ASSEMBLY

(71) Applicant: FOXCONN INTERCONNECT TECHNOLOGY LIMITED, Grand Cayman (KY)

(72) Inventors: Xue-Yuan Xiao, Kunshan (CN); Zhang-Lan Xue, Kunshan (CN); Zi-Qiang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/675,601

(22) Filed: Mar. 31, 2015

(65) Prior Publication Data

US 2015/0280376 A1 Oct. 1, 2015

(30) Foreign Application Priority Data

Mar. 31, 2014 (CN) ..... 2014 1 0126531

(51) Int. Cl.

| | |
|---|---|
| ***H01R 24/60*** | (2011.01) |
| ***H01R 13/46*** | (2006.01) |
| ***H01R 13/52*** | (2006.01) |
| *H01R 107/00* | (2006.01) |

(52) U.S. Cl.

CPC ..... *H01R 24/60* (2013.01); *H01R 13/46* (2013.01); *H01R 13/521* (2013.01); *H01R 2107/00* (2013.01)

(58) Field of Classification Search

CPC ..... H01R 13/6658; H01R 13/5202; H01R 13/5216; H01R 23/025; H01R 13/52

See application file for complete search history.

(56) References Cited

U.S. PATENT DOCUMENTS

| | | | | |
|---|---|---|---|---|
| 5,120,231 | A * | 6/1992 | Masumoto | H05K 5/0056 439/736 |
| 5,535,512 | A * | 7/1996 | Armogan | H01R 13/5202 29/877 |
| 5,662,494 | A * | 9/1997 | Zennamo, Jr. | H01R 13/521 439/589 |
| 6,926,540 | B1 * | 8/2005 | Juntwait | H01R 12/585 439/276 |
| 7,118,646 | B2 * | 10/2006 | Hunkeler | B60R 16/0239 156/293 |
| 7,331,801 | B1 * | 2/2008 | Eichorn | H01R 12/724 439/76.1 |
| 8,770,989 | B2 * | 7/2014 | Ohhashi | H01R 13/5202 439/589 |
| 8,942,001 | B2 * | 1/2015 | Kawai | H05K 5/0052 174/50.5 |

FOREIGN PATENT DOCUMENTS

| | | |
|---|---|---|
| CN | 203521710 | 4/2014 |

* cited by examiner

*Primary Examiner* — Gary Paumen
(74) *Attorney, Agent, or Firm* — Wei Te Chung; Ming Chieh Chang

(57) ABSTRACT

A transmission module assembly comprises a cover and an electrical connector received in the cover. The cover includes a body defining a receiving cavity and a mating section extending forwardly from the body. The connector includes an insulating elongated housing and a number of terminals retained in the housing. Each terminal includes an engaging portion extending forwardly beyond the body into the mating section, a tail portion extending upwardly beyond the housing and a connecting portion retained in the housing. There is a gap between the body and the housing for pouring sealant thereinto. A tuber is defined between the housing and the body, and a pair of stoppers positioned at the body abut forwardly against two lateral sides of the housing in an elongated direction, which can prevent the housing from deforming when temperature changes.

16 Claims, 7 Drawing Sheets

TRANSMISSION MODULE ASSEMBLY

BACKGROUND OF THE INVENTION

1. Field of the Invention

The present invention relates to a transmission module assembly, and particularly to a transmission module assembly for automotive use.

2. Description of Related Art

Transmission module assemblies are widely used in computers or vehicles for controlling various functions. U.S. Pat. No. 6,926,540 discloses such a transmission module assembly comprising a cover, an electrical connector received in the cover, and a printed circuit board installed into the cover to have an electrical connection with the connector. The cover includes a body, a mating section extending forwardly from the body, and a flange. The body has a bottom wall, a front wall, a rear wall, two opposite side walls, and a receiving cavity defined by all said walls and where both the connector and the printed circuit board are received. The connector includes an insulating housing and a plurality of terminals retained in the housing. Each terminal has an engaging portion passing through the body and extending forwardly in the mating section, and a tail portion extending upwardly beyond the housing, and a right-angled connecting portion retaining the terminal in the housing and connecting the engaging portion and the tail portion. With the connector being installed in the receiving cavity of the cover, a kind of potting compound can be added into an interstitial space between the front wall and the housing, i.e. into a depression of the housing, to waterproof the terminals.

It is obvious that when the connector is in a process of forming, high-temperature testing or using with variation of environmental temperature, the elongated housing of the connector will accordingly bend and deform, as a result of that, variation of environmental temperature causes changing stresses inside the housing, which further brings about a change of the interstitial space between the front wall of the body and the housing of the connector, and finally the sealing function fails.

Hence, an improved transmission module assembly is required to overcome the disadvantages of the related art.

SUMMARY OF THE INVENTION

Accordingly, an object of the present invention is to provide a transmission module assembly having a cover, and an electrical connector defining an insulating housing not to deform when environmental temperature changes.

In order to achieve the object set forth, a transmission module assembly provided, which comprises a cover including a body defining a receiving cavity and a mating section extending forwardly from the body, and an electrical connector received in the body. The connector includes an elongated insulating housing, and a number of terminals retained in the housing. Each of the terminals includes an engaging portion extending forwardly through the body into the mating section, a tail portion extending upwardly beyond the housing and a connecting portion retained in the housing and connecting the engaging portion and the tail portion. And wherein the transmission module assembly further defines a gap locating between the body and the housing for sealant being poured thereinto, and a tuber protruding into the gap and locating between the body and the housing, and a pair of stoppers disposed at the body and abutting forwardly against two lateral sides of the housing in an elongated direction.

In order to achieve the object set forth, another transmission module assembly provided, which comprises a cover and an electrical connector. The cover includes a body having a bottom wall, a front wall defining a plurality of first passageways therethrough, a rear wall and two opposite side walls respectively extending upwardly from front, rear edges and two opposite side edges of the bottom wall, a receiving cavity surrounded by the bottom, front, rear and two opposite side walls, and a mating section extending forwardly from the body. The connector comprises an elongated insulating housing fitted forwardly into the receiving cavity and a number of terminals retained in the housing. Each terminal includes an engaging portion extending forwardly through the first passageways of the front wall of the body into the mating section, a tail portion extending upwardly beyond the housing and a connecting portion retained in the housing connecting the engaging portion and the tail portion. Wherein the front wall of the body defines a U-shaped gap to form a gap between the front wall of the body and an front end face of the housing for sealant being poured thereinto, and the transmission module assembly defines a tuber protruding into the U-shaped gap, and the bottom wall has a pair of resilient stoppers extending upwardly therefrom and abutting forwardly against two lateral sides of the housing.

Other objects, advantages and novel features of the invention will become more apparent from the following detailed description when taken in conjunction with the accompanying drawings.

DETAILED DESCRIPTION OF THE PREFERRED EMBODIMENT

Figure 1:
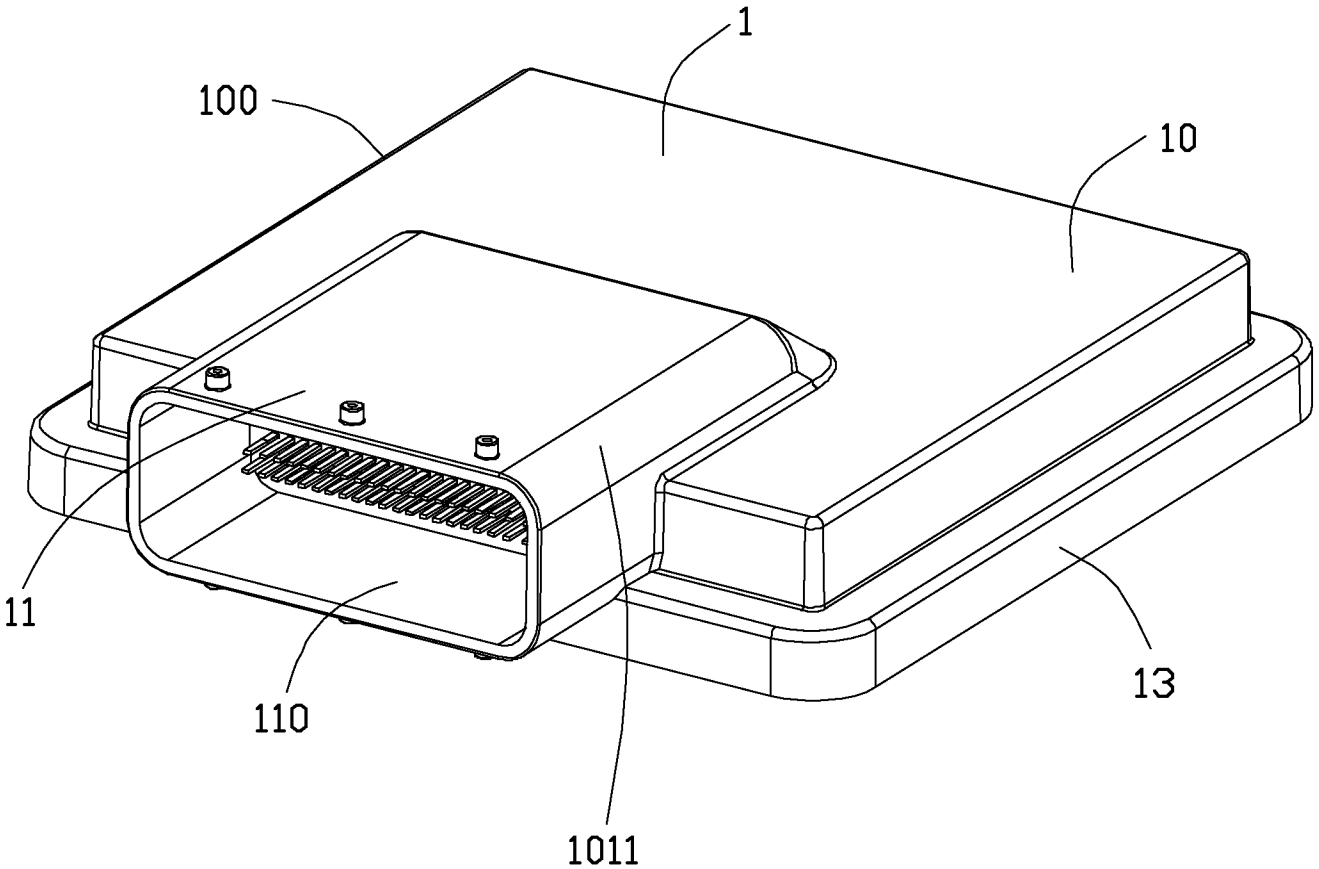
FIG. 1 is a perspective view of a transmission module assembly according to an embodiment of the present invention.
Figure 2:
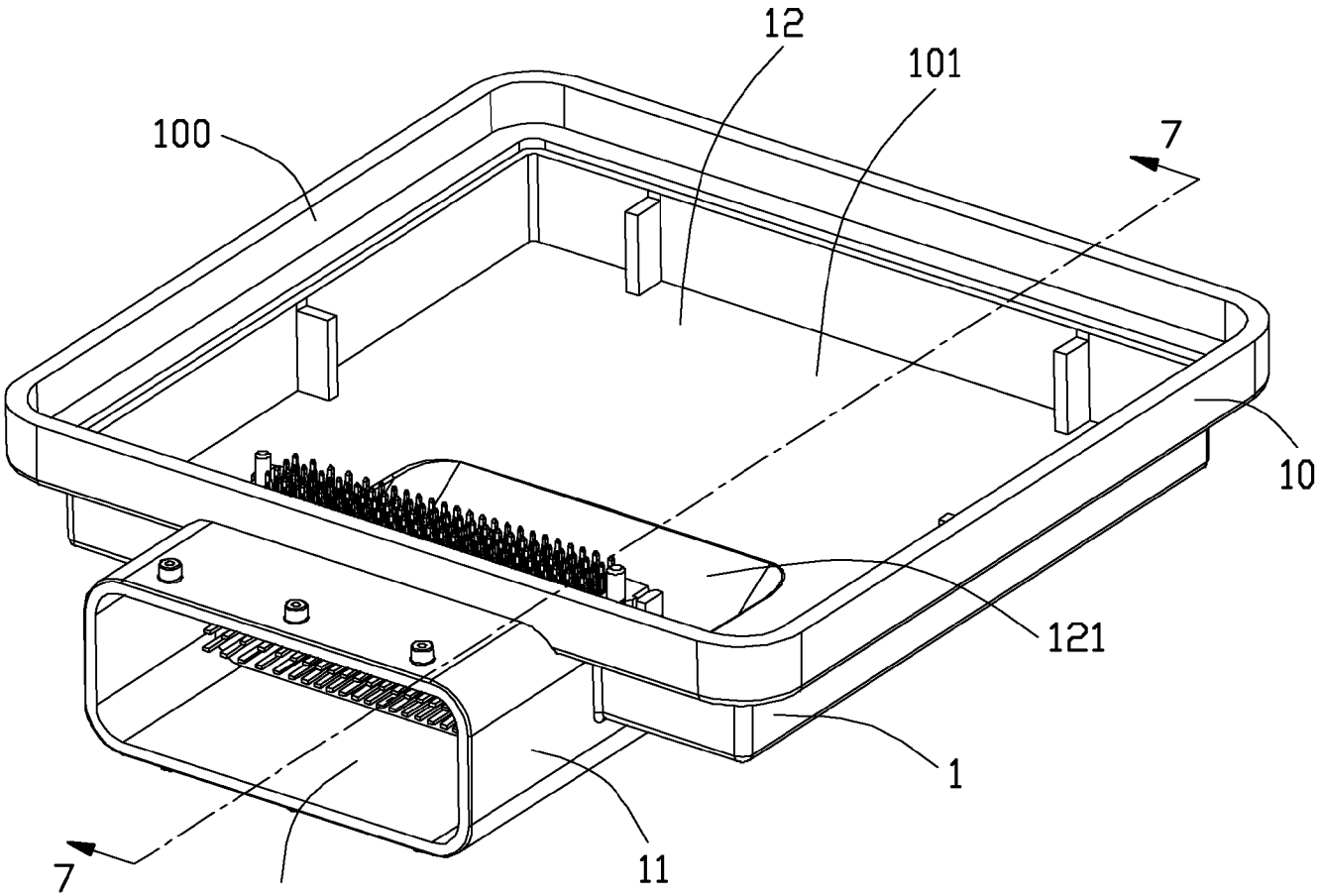
FIG. 2 is another perspective view of the transmission module assembly.
Figure 3:
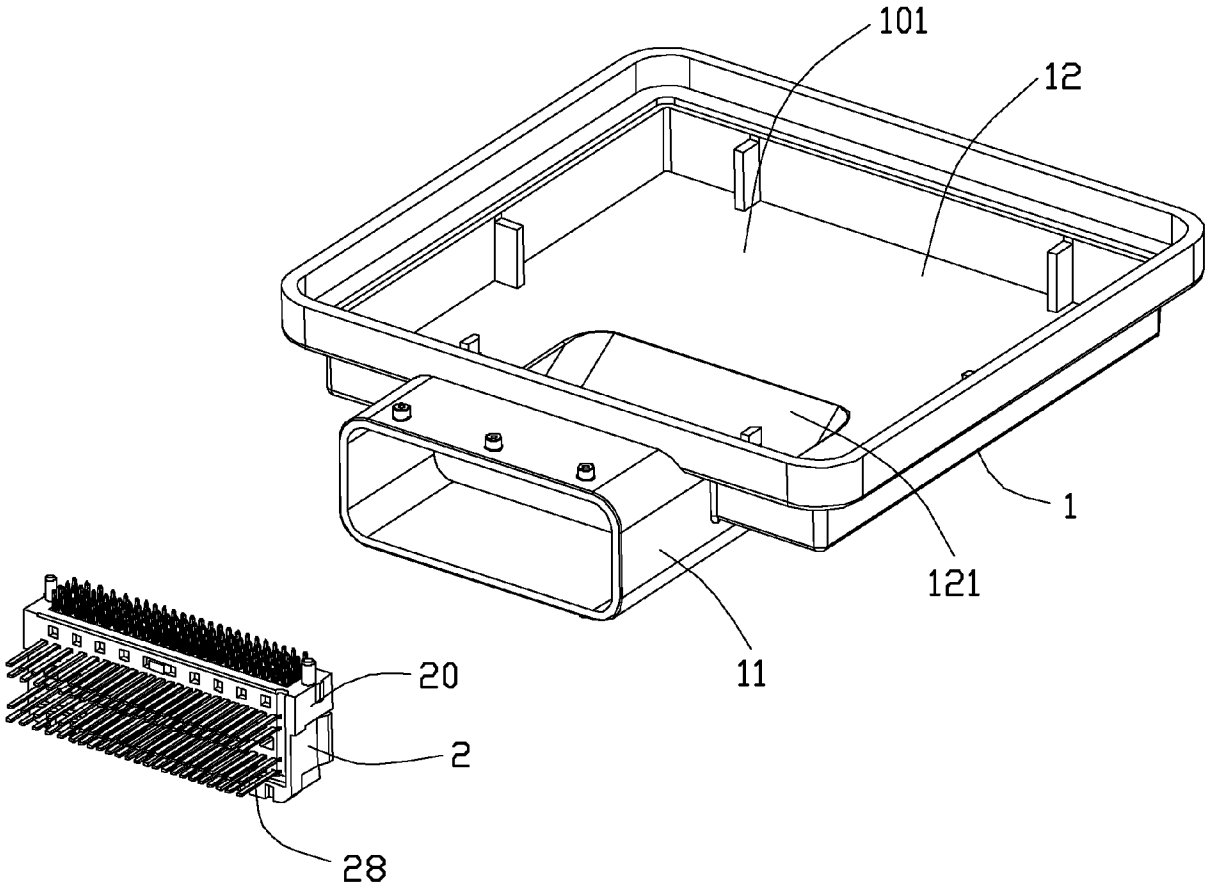
FIG. 3 is a partially exploded perspective view of the transmission module assembly shown in FIG. 2, and showing an electrical connector disengaging with a cover.
Figure 4:
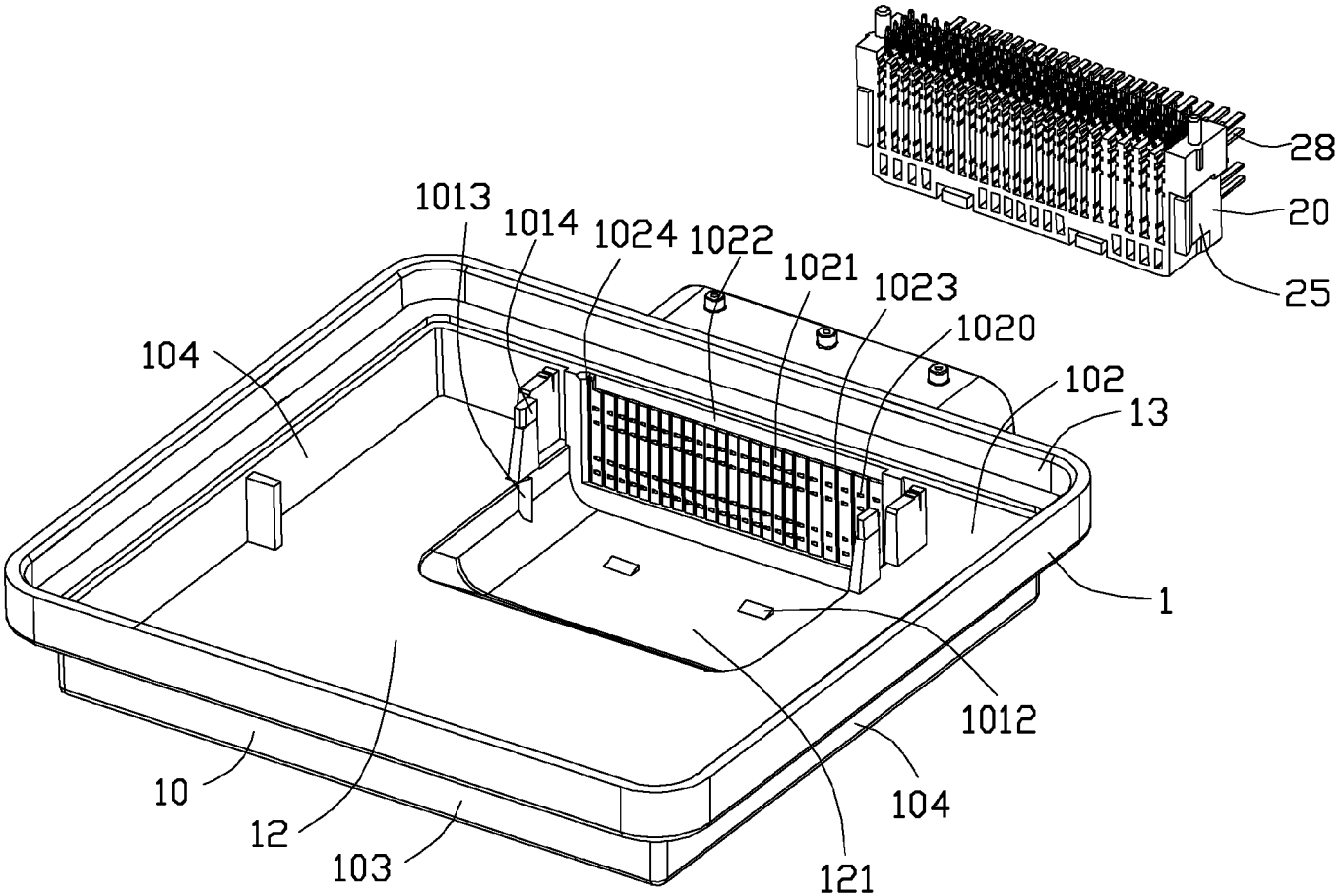
FIG. 4 is a view similar to FIG. 3 but taken from a different aspect.

Reference will now be made in detail to the preferred embodiment of the present invention.

Referring to FIGS. 1, 2, 3 and 4, a transmission module assembly 100 in accordance with the present invention which is adaptable to automotive use, comprises a cover 1 and an electrical connector 2 received in the cover 1. It should be noted that although the transmission module assembly 100 also comprises a printed circuit board installed into the cover 1 to have an electrical connection with the connector 2, and a cover member assembled to the cover 1 to protect the printed circuit board, and so on, they are not found in accompanying drawings and not described in detail for less relevant to the substance of the present invention.

Referring to FIGS. 1, 2, 3 and 4, the cover 1 includes a body 10 defining a receiving cavity 12, a mating section 11 and a flange 13. The body 10 has a bottom wall 101, a front and rear walls 102, 103 respectively extending upwardly from front and rear edges of the bottom wall 101, and a pair of opposite side walls 104 extending upwardly from opposite side edges of the bottom wall 101, together surrounding a receiving cavity 12. The flange 13 is formed on the top of the body 10 by respectively extending upwardly from the front and rear walls 102, 103 and the opposite side walls 104. There is a convex part 1011 formed by further sinking the front of the bottom wall 101, and with the receiving cavity 12 depressing, a receiving depression 121 is formed. The mating section 11 is formed by extending forwardly from the front wall 102 of the body 10 and defines a mating space 110. An upward U-shaped gap 1021 is defined on a rear surface of the font wall 102, passing through the cover 1 upwardly, communicating with the receiving depression 121, and the front wall 102 of the body 10 defines a plurality of first passageways 1020 therethrough which are communicating with the mating space 110 and the U-shaped gap 1021 in the front-to-rear direction. Further, the U-shaped gap 1021 defines an opening 1022 forwardly depressing on the top thereof and a vertical arc-shaped first groove 1024 positioned at one side of the U-shaped gap 1021 communicating therewith. The first passageways 1020 passing through the front wall 102 are arranged in columns and rows, and a channel 1023 is defined between every two adjacent columns of the first passageways 1020, extending along a vertical direction. The convex part 1011 of the bottom wall 101 defines a pair of first locking blocks 1012 extending up into the receiving depression 121, and a pair of second locking blocks 1013 disposed at two sides thereof protruding into the receiving depression 121. Furthermore, the bottom wall 101 defines a pair of resilient stoppers 1014 adjacent to and outside of the receiving depression 121, and preferably the resilient stoppers 1014 define inclined planes to lead the connector 2 to assemble into the body 10. And wherein the second locking blocks 1013 are defined below the stoppers 1014.

In this embodiment, the cover 1 is made from plastic material and is metalized on the inner area to provide EMI (Electro Magnetic Interference) shielding. In other embodiment, the metal coating can also be taken place by a metal cover formed by die casting.

Figure 5:
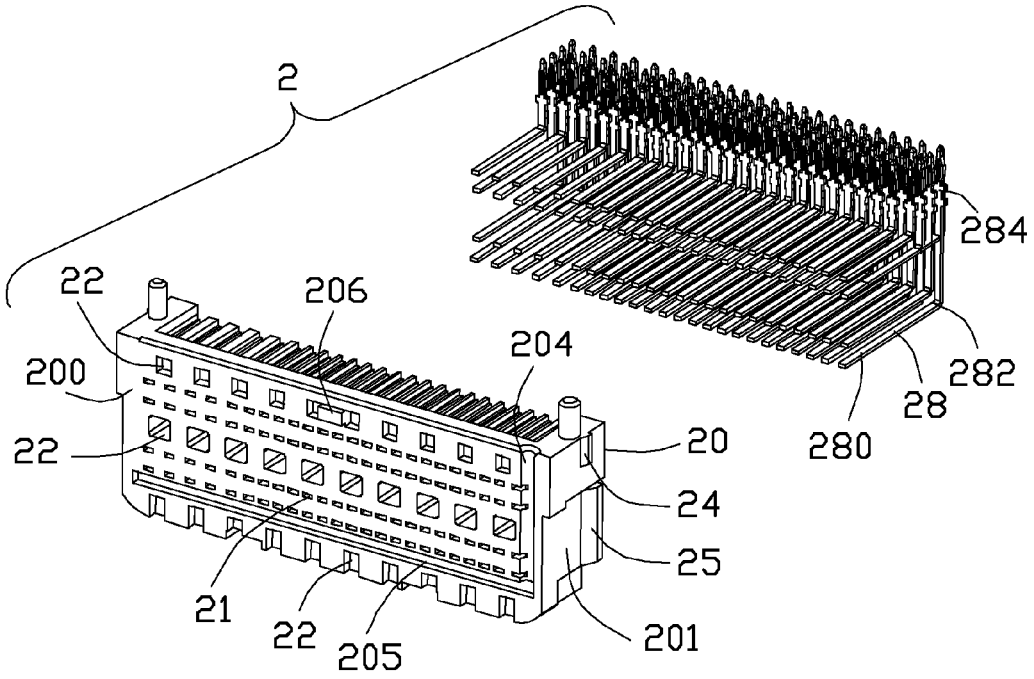
FIG. 5 is an exploded perspective view of the electrical connector of the transmission module assembly.
Figure 6:
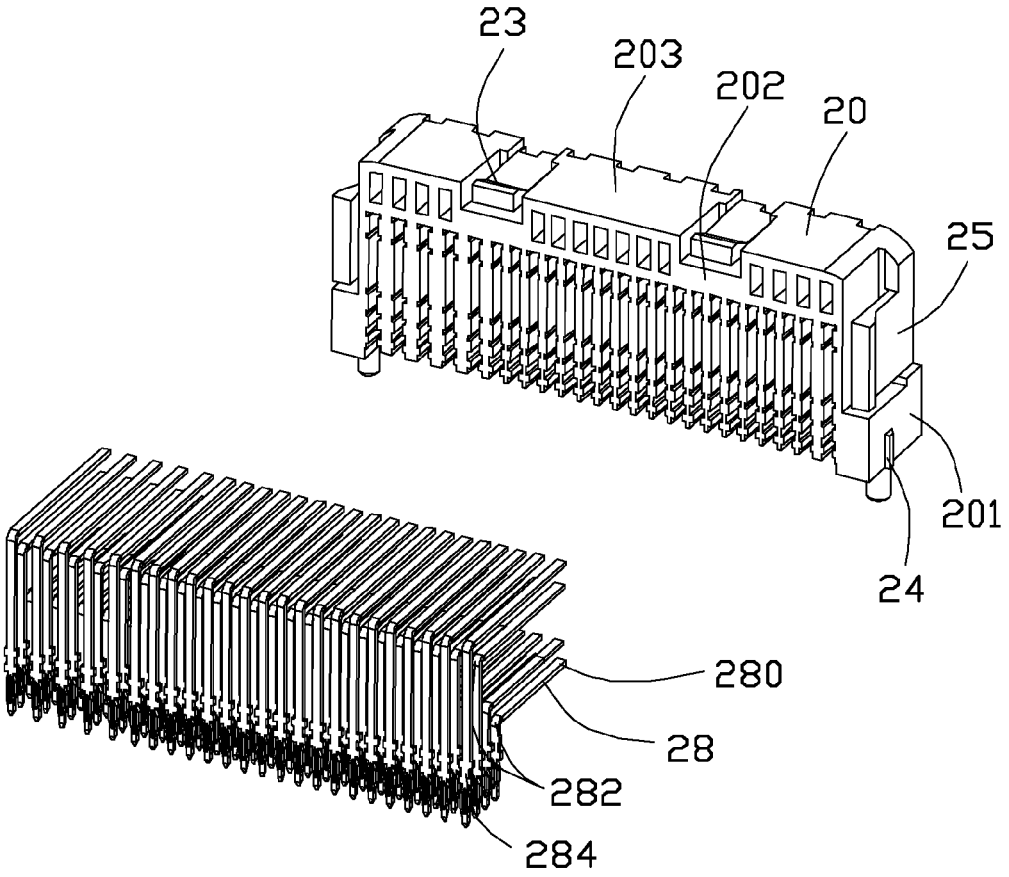
FIG. 6 is a view similar to FIG. 5 but taken from a different aspect.
Figure 7:
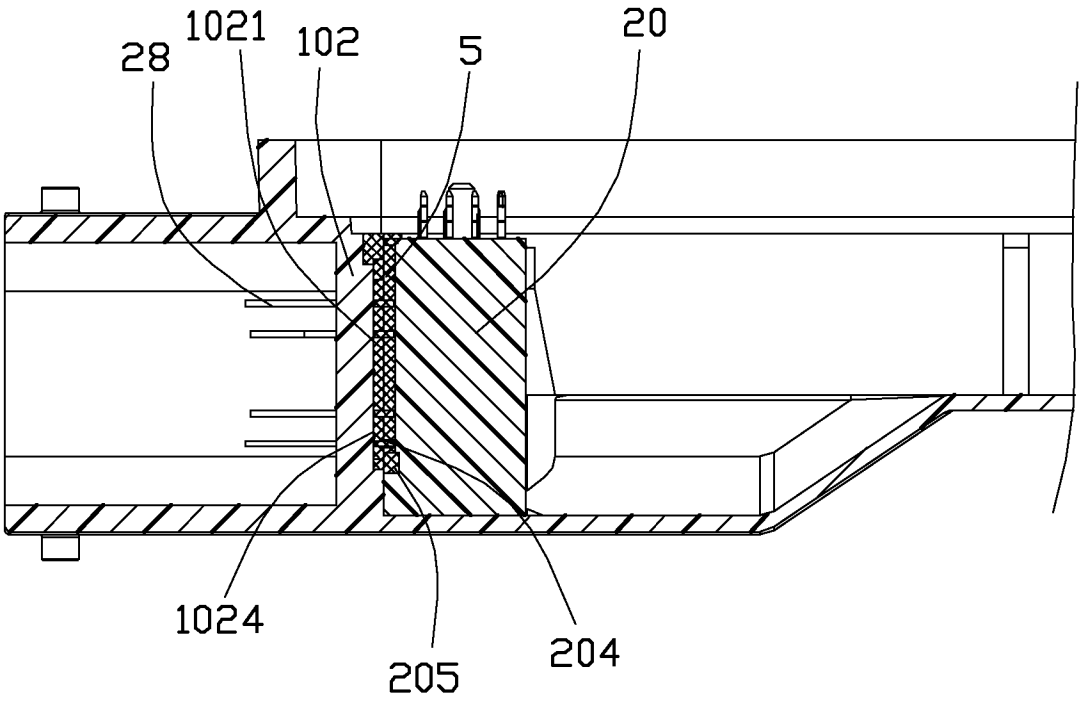
FIG. 7 is a cross-sectional view of the transmission module assembly taken along line 7-7 shown in FIG. 2.

Referring to FIGS. 5 and 6, the connector 2 comprises an insulating housing 20 and a plurality of terminals 28 retained in the insulating housing 20. The housing 20 is elongated and has a front end face 200, a rear end face 202 opposite the front end face 200, a top end face 203 connecting the front end face 200 and the rear end face 202, and two opposite side end faces 201 at two sides of the housing 20. The connector 2 is put in the cover 1 upside down showed in FIGS. 2, 3, and 4, and to conveniently describe the embodiment of the invention, the top end face 203 of the housing 20 is defined under the housing 20. The housing 20 defines several rows of second passageways 21, each passing through the front end face 200 and the rear end face 202 of the housing 20. Three rows of recesses 22 depressing backwardly on the front end face 200 are disposed respectively above and between and below the four rows of second passageways 21, which are useful for preventing the housing 20 from bending and deforming caused by variation of temperature during forming or testing or using. The front end face 200 of the housing 20 further defines a second groove 204 extending along a vertical direction and a third groove 205 extending along a horizontal direction. Furthermore, the second groove 204 is at one lateral side of the front end face 200, and the third groove 205 is on the lower side of the front end face 200 and under the second passageways 21. The housing 20 also comprises a tuber 206 disposed at the upper side of the front end face 200 and extending forwardly therefrom, a pair of first resilient arms 23 disposed on the top end face 203 and extending backwardly therefrom, a pair of second resilient arms 25 disposed on and half way up the two opposite side end faces 201 and extending backwardly therefrom, and a pair of embossments 24 respectively disposed on two opposite side end faces 201 of the housing 20 wherein the second resilient arms 25 are below the embossments 24.

Each terminal 28 includes an engaging portion 280 extending forwardly through the corresponding first passageways 1020 of the front wall 102 of the body 10 and into the mating space 110, a right-angled connecting portion 282 extending backwardly from the engaging portion 280 and received in the second passageways 21 for retaining the terminal 28 in the housing 20, and a tail portion 284 defining a plated through hole extending upwardly from the connecting portion 282 beyond the housing 20. Wherein the diameter of the plated through hole is bigger than the width of the end of the tail portion 284 and smaller than at least one part of the tail portion 284.

In this embodiment, the terminals are assembled to the housing 20, and it is understood that the terminals 28 can also be insert molded with the housing 20.

Referring to FIGS. 1 to 7, when the connector 2 is placed into the body 10 from backward to forward, the stoppers 1014 of the body 10 are pressed forwardly by the embossments 24 on two opposite side end faces 201 of the housing 20 and separate outwards resiliently, and meanwhile, the first resilient arms 23 on the top end face 203 and the second resilient arms 25 on two opposite side end faces 201 deform resiliently under the pressure respectively from the first locking blocks 1012 and the second locking blocks 1013 of the body 10, so as to make the housing 20 easily installed into the receiving depression 121 of the body 10. Subsequently the terminals 28 pass through the first passageways 1020 and the second passageways 21 and extend in the mating space 110 of the mating section 11 for engaging with a complementary device.

After the connector 2 is installed in the receiving cavity 12 of the cover 1, the tuber 206 of the housing 20 protrudes into the U-shaped gap 1021 and abuts against the front wall 102 so as to prevent the connector 2 from deforming forwardly under internal stress, and the two stoppers 1014 of the body 10 abut against the two embossments 24 of the housing 20 so as to prevent the connector 2 from deforming backwardly under internal stress. Wherein said internal stress results from variation of environmental temperature when the connector 2 is in a process of forming or high-temperature testing or using. Furthermore, the first locking blocks 1012 and the second locking blocks 1013 of the body 10 respectively abut against the first resilient arms 23 on the top end face 203 of the housing 20 and the second resilient arms 25 on the two side end faces 201 of the housing 20, which helps fix the connector 2 better and prevents the top end face 203 (which is beneath the housing 20) and half-way parts up two opposite side end faces 201 from deforming backwardly. In another embodiment, it's understood that the tuber 206 can also be formed with the front wall 102 of the body 10.

The body 10 defines a U-shaped gap 1021 on the front wall 102 thereof so as to form a gap between the front end face 200 of the housing 20 and the rear surface of the front wall 102 of the body 10 for sealant 5 poured thereinto. Optionally the U-shaped gap 1021 can also be defined on the front end face 200 of the housing 20. Said first groove 1024 and said second groove 204 combine into a vertical slot communicating with said third groove 205. Wherein both said vertical slot and said third groove 205 are communicating with said U-shaped gap 1021 along the front-to-rear direction, and the bottom surface of said third groove 205 is below the bottom surface of said U-shaped gap 1021. As a result, said U-shaped gap 1021, at one side thereof communicating with said vertical slot, at the bottom thereof communicating with said third groove 205. It's understood that, in other embodiment, the bottom surface of said third groove 205 can also be in alignment with the bottom surface of said U-shaped gap 1021. In order to pour the sealant 5 into the U-shaped gap 1021, a needlelike injecting tool with an injection hole is used, being inserted into said vertical slot until said injection hole reaching said third groove 205, subsequently, the sealant 5 directly flowing out of the injection hole into said third groove 205, so that the sealant 5 fills up the U-shaped gap 1021 from bottom to top which can prevent bubbles from forming in the sealant 5 and further advance the reliability of waterproofing. Said third groove 205, accelerating the sealant 5 filling up the U-shaped gap 1021 from left to right as well as from bottom to top, speeds up injecting process for a lower cost. The constructions like the housing 20 and the body 10 defining said tuber 206 and said stopper 1014 and et al make said housing 20 not bend or deform, so that the gap between the housing 20 and the front wall 102 will not change, which assures the sealant 5 of providing a reliable waterproof function.

In this embodiment, said first groove 1024 and said second groove 204 combine into said vertical slot while said third groove 205 is defined on the housing 20 independently. Optionally said third groove 205 can also be defined on the front wall 102 of the body 10 alone or divide into two parts respectively disposed on the front wall 102 and the housing 20. Furthermore, it is optional for said vertical slot to be a combination of two parts respectively on the front wall 102 and the housing 20, or an independent one singly on the front wall 102 or the housing 20, that is to say, as long as said third groove 205 forms between said front end face 200 of the housing 20 and the front wall 102 of the body 10, communicating with the bottom of said U-shaped gap 1021 and said vertical slot, enabling the needlelike injecting tool to reach said third groove 205 and inject the sealant 5 thereinto, one object of this invention is achieved. Furthermore, in other embodiment, the vertical slot can also be disposed in middle of said third groove 205, and said vertical slot or said third groove 205 can also be inclined to facilitate the sealant 5 flowing. Furthermore, the opening 1022 on the top of the U-shaped gap 1021 is convenient to watch how the sealant 5 is poured and prevents the sealant 5 from spilling out of the U-shaped gap 1021 by receiving more sealant 5 when the U-shaped gap 1021 is going to be full. And it will be appreciated that more sealant 5 further increases the reliability of waterproof function.

There are a plurality of channels 1023, each defined between every two adjacent columns of the first passageways 1020, extending along the vertical direction. With the sealant 5 being poured into the U-shaped gap 1021, it penetrates into the channels 1023, which further increases the bond strength between the sealant 5 and the front wall 102 of the body 10. Optionally, each of the channels 1023 can also be defined between every two adjacent rows of the first passageways 1020, extending along the horizontal direction. Furthermore, the channels 1023 can also be defined on the front end face 200 of the housing 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A transmission module assembly comprising:

a cover including a body defining a receiving cavity, a mating section extending forwardly from the body; and an electrical connector received in the body and comprising:

an elongated insulating housing; and a number of terminals retained in the housing, each of the terminals including an engaging portion extending forwardly through the body into the mating section, a tail portion extending upwardly beyond the housing and a connecting portion retained in the housing and connecting the engaging portion and the tail portion;

wherein the transmission module assembly further defines a gap located between the body and the housing for sealant being poured thereinto, and a tuber sandwiched locating between the body and the housing and traversing the gap, and a pair of stoppers disposed at the body and abutting forwardly against two lateral sides of the housing in an elongated direction.

2. The transmission module assembly as claimed in claim 1, wherein the tuber is formed integrally with the housing and abuts against the body.

3. The transmission module assembly as claimed in claim 1, wherein the gap is defined as a U-shaped gap by the cover and passes through a top surface of the cover.

4. The transmission module assembly as claimed in claim 3, wherein a pair of embossments are defined at two sides of the housing in the elongated direction, and the stoppers of the body abut against the respective embossments forwardly.

5. The transmission module assembly as claimed in claim 4, wherein the housing is fitted forwardly into a receiving depression which is formed by further depressing downwardly the receiving cavity, and defines a pair of first resilient arms extending backwardly from a bottom side thereof; the body has a pair of first locking blocks protruding upwardly into the receiving depression and abutting against the respective first resilient arms forwardly.

6. The transmission module assembly as claimed in claim 5, wherein the housing defines a pair of second resilient arms extending backwardly from two sides of the housing and located below the embossments; the body further defines a pair of second locking blocks, formed at two sides of the receiving depression and protruding into the receiving depression; the second locking blocks abut against the respective second resilient arms forwardly.

7. The transmission module assembly as claimed in claim 3, wherein the housing further defines a second groove extending along an vertical direction and a third groove extending along an horizontal direction communicating with the U-shaped gap.

8. The transmission module assembly as claimed in claim 7, wherein the U-shaped gap further defines a vertical first groove combining with said second groove into a vertical slot communicating with said third groove and said U-shaped gap.

9. The transmission module assembly as claimed in claim 8, wherein the U-shaped gap, at one side thereof communicating with the vertical slot, at the bottom thereof communicating with the third groove.

10. A transmission module assembly comprising:

a cover including a body having a bottom wall, a front wall defining a plurality of first passageways therethrough, a rear wall and two opposite side walls respectively extending upwardly from front, rear edges and two opposite side edges of the bottom wall, a receiving cavity surrounded by the bottom, front, rear and two opposite side walls, and a mating section extending forwardly from the body; and an electrical connector received in the body, the connector comprising:

an elongated insulating housing fitted forwardly into the receiving cavity; and a number of terminals retained in the housing, each of which includes an engaging portion extending forwardly through the first passageways of the front wall of the body into the mating section, a tail portion extending upwardly beyond the housing and a connecting portion retained in the housing connecting the engaging portion and the tail portion;

wherein the front wall of the body defines a U-shaped gap to form a gap between the front wall of the body and an front end face of the housing for sealant being poured thereinto; the transmission module assembly defines a tuber protruding into the U-shaped gap and sandwiched between the front wall of the body and the front end face of the housing, and the bottom wall has a pair of resilient stoppers extending upwardly therefrom and abutting forwardly against two lateral sides of the housing.

11. The transmission module assembly as claimed in claim 10, wherein the tuber is formed integrally with the housing and abuts against the front wall of the body.

12. The transmission module assembly as claimed in claim 10, wherein a pair of embossments are defined at two sides of the housing in an elongated direction, and the stoppers of the body abut against the respective embossments forwardly.

13. The transmission module assembly as claimed in claim 10, wherein the receiving cavity defines a receiving depression formed by further depressing downwardly the receiving cavity; the housing defines a pair of first resilient arms extending backwardly from an top end face thereof, and a pair of second resilient arms extending backwardly from two sides of the housing in an elongated direction; the body defines a pair of first locking blocks disposed at the bottom wall thereof protruding upwardly into the receiving depression abutting forwardly against the first resilient arms, and a pair of second locking blocks disposed at two sides of and protruding into the receiving depression abutting forwardly against the second resilient arms; and the second locking blocks are defined below the stoppers.

14. A signal transmission module comprising:

a box forming a front wall with a plurality of first passageways therethrough in a front-to-back direction, said first passageways forming a matrix zone viewed in the front-to-back direction;

a receiving depression formed in the box and defining an upward face and a pair of side faces;

at least one locking block formed on one of the upward face and said pair of side faces of the receiving depression;

an electrical connector assembled to the box in an upside-down manner with a top portion partially received in the receiving depression along the front-to-back direction, and including an insulative housing located behind the front wall, and a plurality of contacts retained in the housing, each of said contacts defining a contacting section extending forwardly into the corresponding first passageway;

the housing forming a top surface and a pair of side surfaces;

at least one resilient arm formed on one of the top surface and the pair of side surfaces to lock to the corresponding locking block along said front-to-back direction; and a gap formed between the front wall and the housing in said front-to-back direction around said matrix zone and filled with sealant; wherein one of said housing and said front wall further forms a tuber thereon around the gap to abut against the other in the front-to-back direction so as to cooperate with the solidified sealant for preventing upward movement of the housing away from the receiving depression.

15. The signal transmission module as claimed in claim 14, wherein said box forms a resilient locking stopper and the housing forms an embossment to engage with each other in the front-to-back direction.

16. The signal transmission module as claimed in claim 15, wherein said embossment is higher than the locking block in a vertical direction perpendicular to said front-to-back direction.

* * * * *